US008322715B2

(12) United States Patent
Mandel et al.

(10) Patent No.: US 8,322,715 B2
(45) Date of Patent: Dec. 4, 2012

(54) MEDIA TRANSPORT SYSTEM WITH SHAFT-MOUNTED NIP LEAD-IN ELEMENTS

(75) Inventors: Barry Paul Mandel, Fairport, NY (US); Henry Thomas Bober, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 6 days.

(21) Appl. No.: 12/508,557

(22) Filed: Jul. 23, 2009

(65) Prior Publication Data

US 2011/0018190 A1 Jan. 27, 2011

(51) Int. Cl.
*B65H 5/00* (2006.01)

(52) U.S. Cl. ..... 271/264; 271/272

(58) Field of Classification Search ..... 271/264, 271/272

See application file for complete search history.

(56) References Cited

U.S. PATENT DOCUMENTS 6,279,901 B1 * 8/2001 Fulmer ..... 271/272
2006/0043666 A1 * 3/2006 Piccinino, Jr. ..... 271/276

FOREIGN PATENT DOCUMENTS

JP 04041352 A * 2/1992

* cited by examiner

*Primary Examiner* — Michael McCullough
(74) *Attorney, Agent, or Firm* — Joesph E. Root

(57) ABSTRACT

A media transport system comprising a roller system, a baffle, and at least one lead-in guide positioned to guide a sheet towards the roller system. The roller system includes a drive roller and an idler roller forming a nip, each roller being mounted on a corresponding drive shaft and an idler shaft, respectively. The lead-in guide, lying at an angle to the baffle, is coupled to at least one of the drive shaft or an idler shaft. The mounting of the lead-in guide eliminates tolerances between the lead-in guide and the nip due to baffle flatness, or baffle and shaft deflections as the lead-in guide is positioned by the drive shaft that locates the nip roller. This arrangement enables the lead-in guide to direct a leading edge of the sheet substantially close to a tangent plane of the nip and minimizes drive forces in the system.

17 Claims, 7 Drawing Sheets

MEDIA TRANSPORT SYSTEM WITH SHAFT-MOUNTED NIP LEAD-IN ELEMENTS

TECHNICAL FIELD

The present disclosure relates to media transport systems, and more particularly to nip lead-in systems for improved paper handling.

BACKGROUND

Image forming devices such as copiers, printers, and facsimile machines include media transport systems that employ baffles, drive rollers, and idler rollers to guide and drive media along a media transport path. A baffle is typically made of sheet metal or plastic, and includes cutout sections. The drive and idler rollers protrude through these cutout sections and are responsible for driving the media via a nip formed by a pair of rollers. Contact between a leading edge of a sheet and a nip roller is known to generate torque spikes of magnitudes that depend upon factors such as the baffle to nip roller geometry, media stiffness, and thickness. It is, therefore, desirable to configure the baffle to nip roller entrance geometry for smoothly guiding the sheet into a tangent plane of the nip, thus, minimizing sheet disturbances and the sheet drive-torque spikes.

In curved media transports, especially while transporting very stiff, thick, or heavy media, such as those employed in folding carton-packaging applications, the leading edge of a sheet is naturally biased against the outer baffle. Such a natural bias may be employed to advantage by positioning the nip tangent plane near the outer baffle surface to ensure optimal entry of the sheet into the nip. In practical systems, however, baffle characteristics such as length, flatness, deflection, and positioning relative to nip rollers, introduce tolerances and limit optimal positioning of the nip relative to the baffle. As it is undesirable to have the nip positioned below the surface of the baffle, the nip must be nominally positioned above the baffle surface by a dimension based on the total tolerances of the system. Media transport module and baffle manufacturers have endeavored to achieve tight overall tolerances by controlling individual tolerances, as well as adding stiffeners to the baffle for producing precise, flat, and rigid parts that do not deflect under load. Such measures, however, increase the manufacturing time and cost of the media transport systems.

It would thus be, highly desirable to have a relatively simple and cost effective device for optimally guiding the sheet into the nip, thereby reducing the drive force required for driving the sheet along the media transport path while simultaneously allowing cost effective manufacturing methods and tolerances.

SUMMARY

One aspect of the present disclosure describes a media transport system comprising a roller system including a drive roller and an idler roller forming a nip, each roller being mounted on a corresponding drive shaft and an idler shaft respectively. The system further includes a baffle positioned to guide sheet media into the nip. The baffle is coupled to the roller system for precisely locating the baffle relative to the roller system. The baffle further includes at least one lead-in guide to direct a leading edge of the sheet to the nip formed by the contact of the drive roller and the idler roller.

A further embodiment of the disclosure relates to a media transport system including a roller system, at least one baffle positioned to guide a sheet to the roller system, and at least one lead-in guide coupled to both the baffle and the roller system. The roller system further includes a drive roller and an idler roller forming a nip, the rollers being mounted on a drive shaft and an idler shaft, respectively. The lead-in guide, lying at an angle to the baffle, directs a leading edge of the sheet to the nip.

Another embodiment of the disclosure discloses a sheet media transport system comprising a drive roller mounted on a drive shaft, an idler roller mounted on an idler shaft, a baffle system that further includes a baffle element, and at least one lead-in guide coupled to at least one of the drive shaft or the idler shaft. The system also includes a nip between the drive roller and the idler roller. In the system, the baffle element is positioned substantially close to the nip tangent plane such that the lead-in guide is positioned to guide a sheet towards the tangent point of the nip.

DETAILED DESCRIPTION

Figure 1:
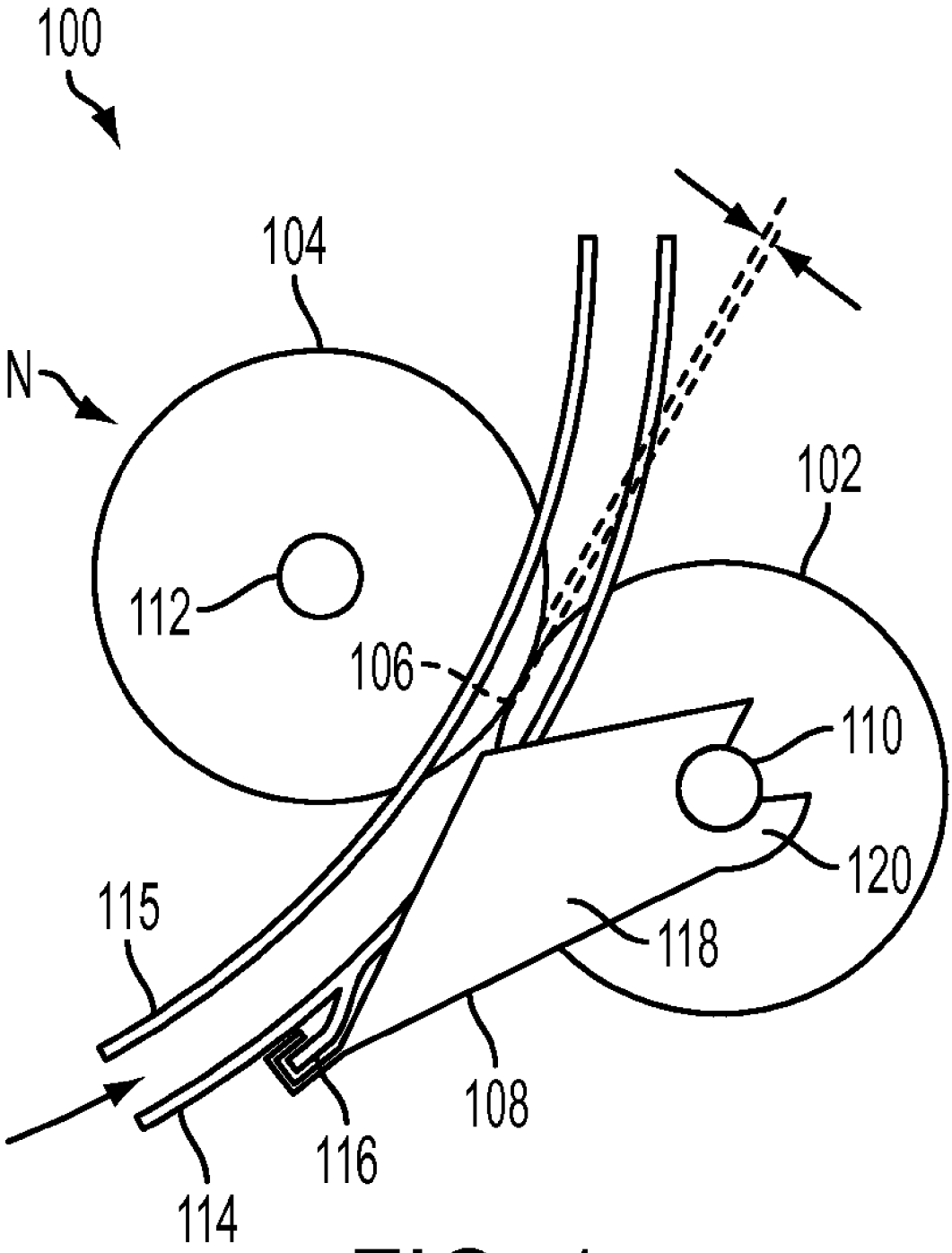
FIG. 1 depicts a curved media transport system including a lead-in guide according to an embodiment of the present disclosure.

The following detailed description is made with reference to the figures. Preferred embodiments are described to illustrate the claimed subject matter, and not to limit its scope, which is defined by the claims. Those of ordinary skill in the art will recognize a variety of equivalent variations on the description that follows.

The following terms are used throughout this document, and are defined here for clarity and convenience.

Nip centerline: The line tangent to the drive roller and idler roller in a media transport nip formed by the drive roller and idler roller. The centerline passes through the common contact point between the drive roller and idler roller.

Nip Tangent plane: A line or plane aligned with the nip centerline.

Baffle flatness: The straightness of a baffle.

Baffle to frame distance: A tolerance contributor due to mounting or locating a baffle to a side frame.

Frame hole-to-hole distance: A tolerance contributor within a side frame that contributes to the mounting or locating of a baffle relative to a drive shaft in a side frame.

Shaft to frame distance: A tolerance contributor due to mounting or locating a drive shaft to a side frame.

Shaft run-out: A tolerance contributor due to the eccentricity or shaft straightness of a drive shaft.

Shaft deflection: A tolerance contributor due to a deflection of a drive shaft when loaded by an idler roller.

Roll Diameter: A tolerance contributor due to the diameter tolerance of a drive roller.

Lead-in guide to shaft mounting: A tolerance contributor due to mounting or locating a lead-in guide to a drive shaft.

Lead-in guide tolerance: A tolerance contributor due to the manufacturing tolerance of a lead-in guide.

Nip penetration: The distance by which a drive roller protrudes above the surface of a baffle.

Further, in the following description the terms "media", "sheet", "print media" or "sheet media" refer to physical sheets of paper, plastic, cardboard, or other suitable physical substrates that can be employed for printing, whether precut or initially web fed and subsequently cut.

A media transport system in an image-forming device employs one or more sets of baffles and rollers for directing a sheet along a media transport path. The present disclosure describes a baffle system including at least one lead-in guide coupled to a roller shaft of at least one of a pair of nip rollers for precisely guiding a sheet towards a tangent plane of the nip. As the lead-in guide is attached to, and moves along with the roller shaft, it is largely unaffected by positional variations created due to factors such as manufacturing tolerances of baffle, shaft and frame components, defects in baffle flatness, baffle deflection, shaft deflection, shaft run out, and so on. Consequently, the drive force required by the media transport system, even for transporting heavy media, can be greatly reduced by ensuring optimal entry of the leading edge of the sheet media into the nip.

Conventional media transport systems employ baffles to guide the sheet towards the nip formed by a set of nip rollers. Typically, the baffles are made of sheet metal or plastic, and maintaining absolute flatness all along the baffle length becomes a challenge, particularly given the need to manufacture the device within market-driven cost constraints. Further, positioning the rollers relative to the baffles is subject to considerable variation, as the tolerances applicable to individual components introduce accumulations of these variations. Thus, individual tolerances, relating to factors such as baffle positioning, baffle flatness, baffle deflection, roller shaft straightness, or shaft assembly Total Indicated Run-out (TIR), can accumulate to introduce large variations in the actual position of a sheet approaching a nip.

This issue becomes acute for a curved media transport path, where the leading edge of the sheet rides against the inner surface of the outer baffle. Ideally, the nip position should be close to the inner surface of the outer baffle to guide the sheet smoothly into the tangent plane of the nip. Any deviation from this ideal relative positioning produces a marked torque spike, especially when driving heavy or thick media. Such torque spikes can be reduced, or avoided by bringing the sheet neatly around the curved media path baffling towards the tangent plane of the nip.

FIG. 1 illustrates an embodiment of a media transport system 100 described in the present disclosure. This system includes a roller system comprising a set of loaded nip rollers including a drive roller 102 and an idler roller 104, which are loaded against each other at nip 106, exerting a mutual, normal force N, which serves to engage a sheet and convey it along a curved media transport path. The rollers 102 and 104 are mounted on a corresponding drive shaft 110, and an idler shaft 112, respectively. It will be understood by those in the art that either or both of these shafts can be driven for guiding the sheet through the nip 106.

Further, the media transport system 100 includes an outer baffle 114, typically mounted to a media transport frame (not shown). The outer baffle 114 further includes a lead-in guide 108 positioned by the drive shaft 110, and rotationally constrained by an attachment to the outer baffle 114. As the lead-in guide 108 moves together with the drive shaft 110, it is thus, largely unaffected by tolerances arising out of factors such as shaft straightness and run out, baffle mounting tolerances, baffle deflection or variations in baffle flatness. A coupling flange 118 extends from the lead-in guide 108 to the drive shaft 110, culminating in a snap-on element 120 adapted to snap-on to the drive shaft 110, as shown. Further, the lead-in guide 108 is coupled to a slot 116 or other suitable feature in the outer baffle 114. Such coupling constrains the rotational movement of the lead-in guide 108 about the drive shaft 110, and enables precise positioning of the lead-in guide 108 relative to the nip 106 even while the outer baffle 114 is displaced relative to the drive shaft 110. The manner in which the outer baffle 114 is coupled to the drive shaft 110 is discussed in more detail in connection with FIG. 2 in the following sections. The lead-in guide 108 further includes a ramp surface lying at an angle to the remainder of the outer baffle 114, the angle determined for guiding the sheet substantially close to the tangent plane of the nip 106. Although not shown in FIG. 1, the side portions of this lead in guide could optionally be contoured to follow the curvature of the nip roller and could also extend all the way to the contact point of the nip.

Figure 2:
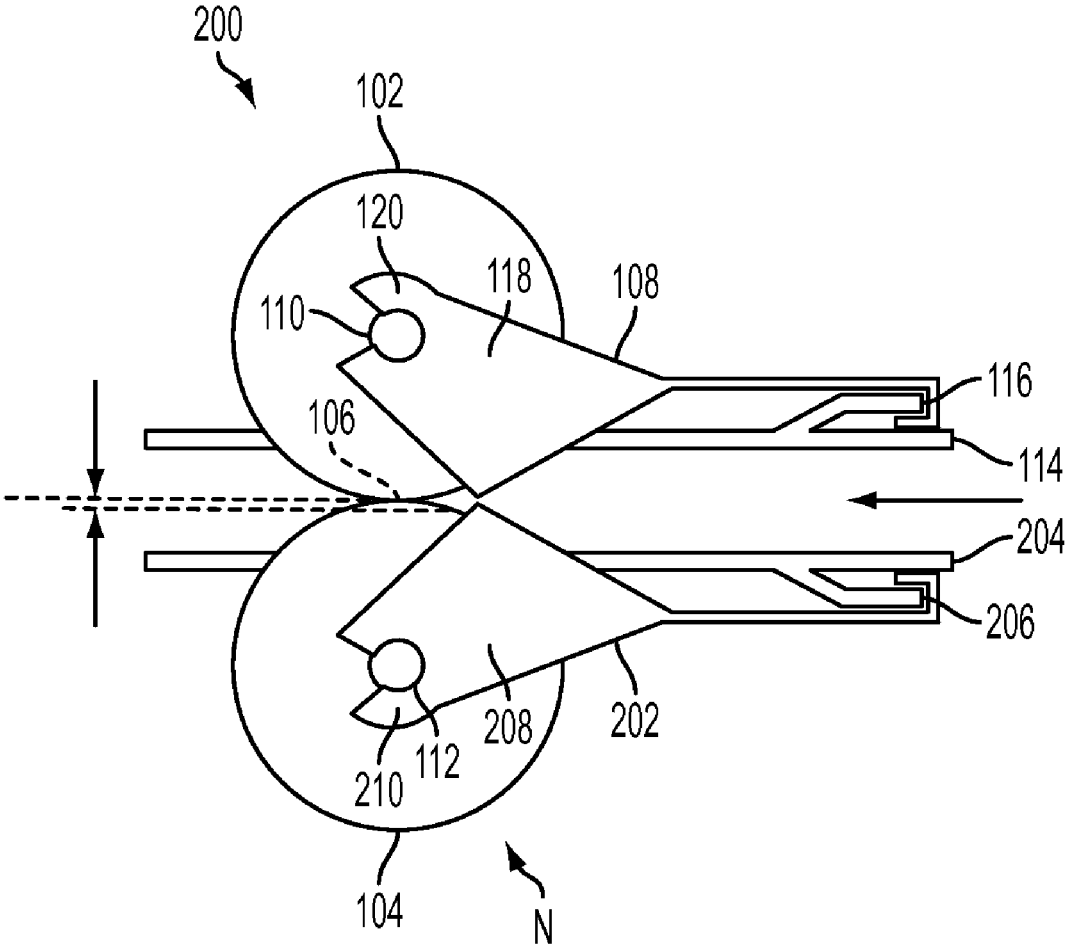
FIG. 2 depicts another embodiment of a flat media transport system employing two lead-in guides.
Figure 5:
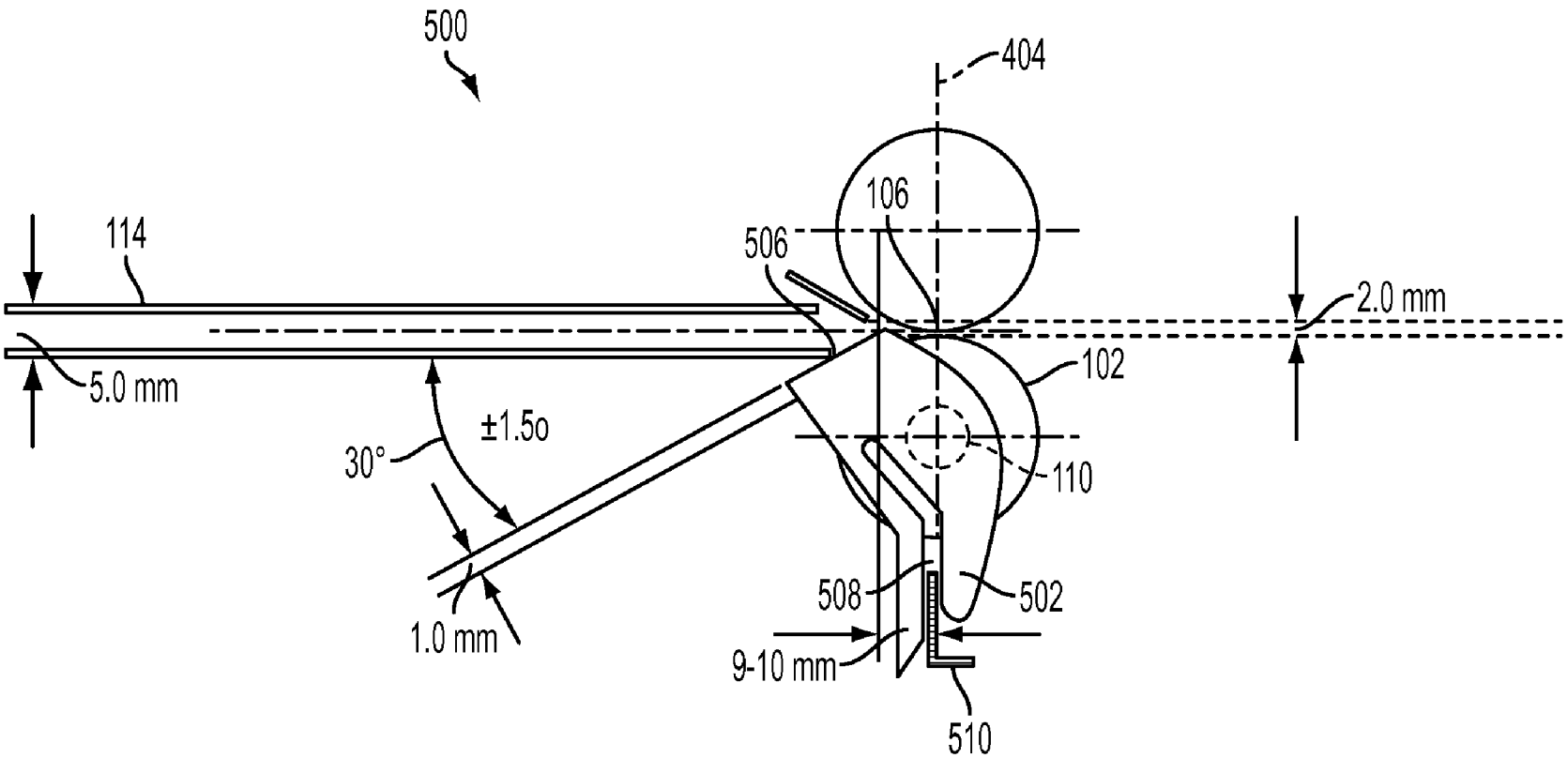
FIG. 5 illustrates an embodiment of a media transport system including a separate structural element for constraining the angular movement of a lead-in guide.
Figure 6:
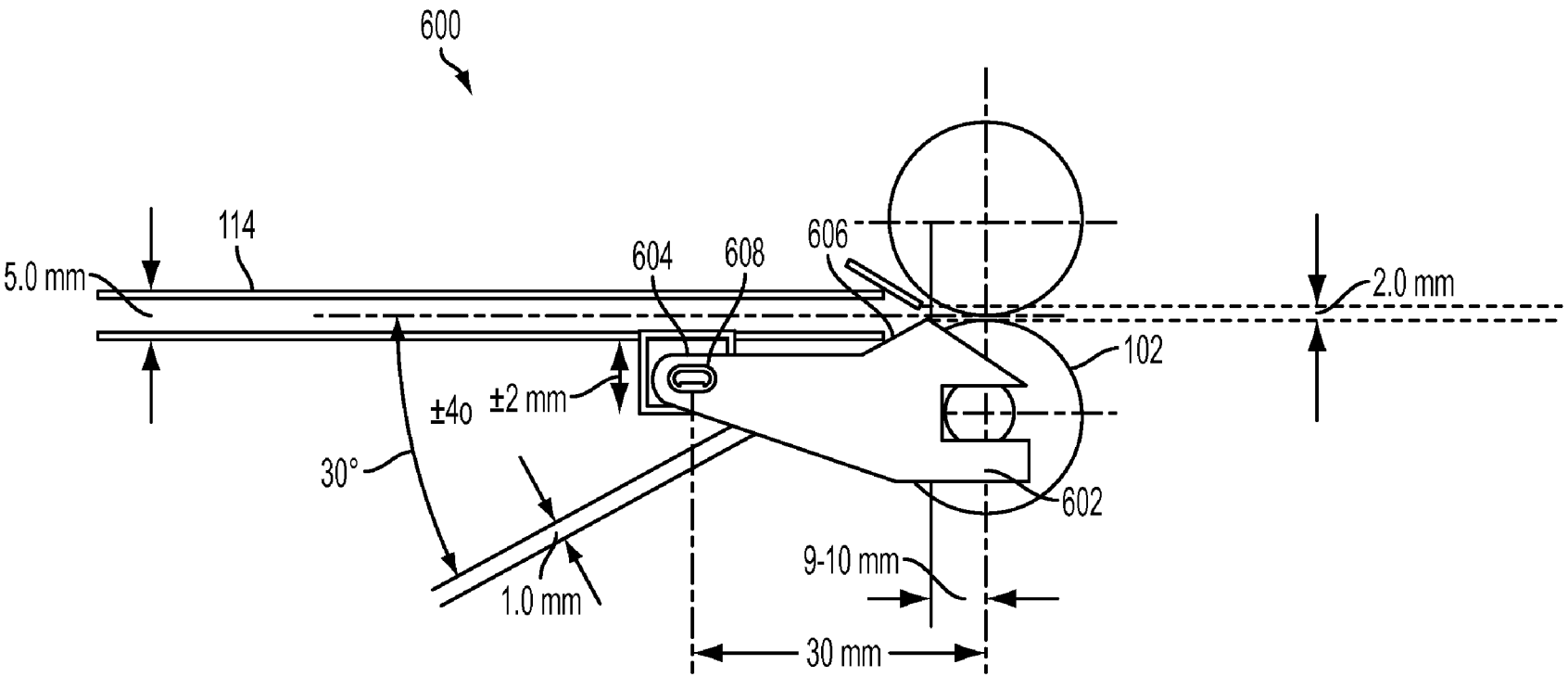
FIG. 6 illustrates a further embodiment of a media transport system including baffle elements employed for constraining the angular movement of a lead-in guide.
Figure 7:
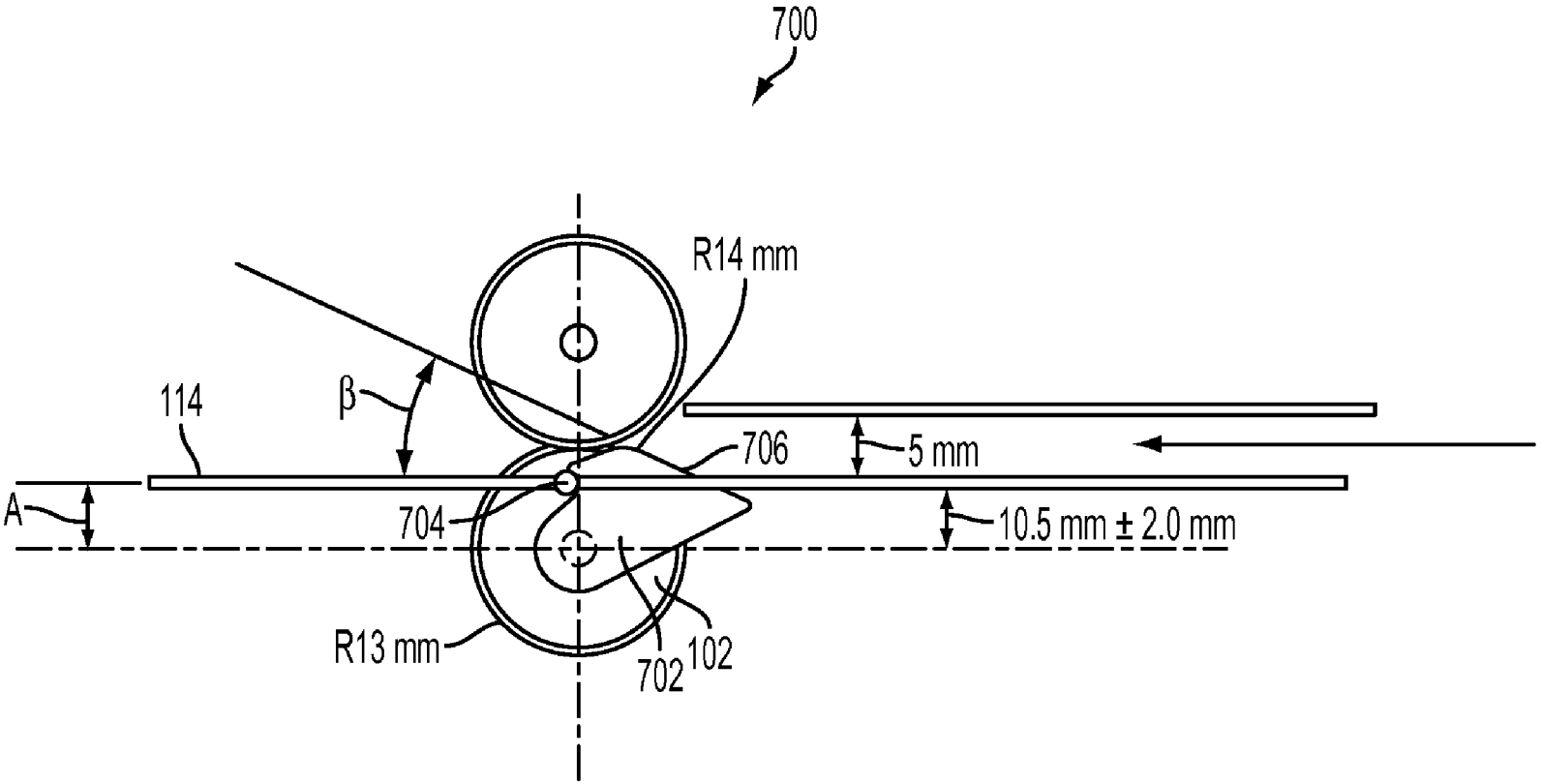
FIG. 7 illustrates yet another embodiment of a media transport system including a baffle element employed for constraining the angular movement of a lead-in guide.

FIG. 2 depicts an alternative media transport system 200, an embodiment of the disclosure employing two lead-in guides 108 and 202, coupled to the drive shaft 110 and the idler shaft 112, respectively. Coupling flanges 118 and 208 extend from each of the lead-in guides 108 and 202 to the respective shafts, culminating in the snap-on elements 120 and 210, adapted to snap-on to each of the drive shaft 110 and the idler shaft 112, respectively, as shown. Although not shown in this figure, the lead in guides 108 and 202 can optionally extend to the nip tangent plane and to the nip centerline to guide the media all the way into the nip. The snap-on elements 120 and 210 allow the lead-in guides 108 and 202 to be accurately positioned in relation to the rollers 102 and 104, thereby guiding the sheet accurately into the tangent plane of the nip 106. The lead-in guides 108 and 202 can be rotationally constrained by being coupled to the slots 116 and 206 present in the outer baffles 114 and 204, respectively. Although the illustrated embodiment employs the slots 116 and 206 for constraining the angular movement of the lead-in guides 108 and 202, it would be apparent to a person of skill in the art that several other customizations for constraining angular movement are possible. For example, FIGS. 5-7 illustrates several additional embodiments of lead-in guides customized for providing anti-rotation features for the lead-in guides 108 and 202.

Mounting the lead-in guides 108 and 202 directly on the drive shaft 110 and the idler shaft 112, respectively, addresses the problem of tolerance stack-ups, a well-known effect of accumulated variations resulting from the tolerances assigned to multiple components. Typical media transport assemblies employ a pair of side frames (not shown), to which the baffles are secured and positioned, and to which the drive roller shaft is mounted. The idler shaft 112 is positioned opposite to, and commonly loaded against the drive roller 102. In structures generally known in the art, a number of factors, such as baffle flatness, shaft straightness, and roller diameter, as well as both static and dynamic shaft deflections, contribute to the accumulation of tolerances and variations in the position of the terminus of the baffle lead in to nip plane. The configuration of the present disclosure here avoids those problems, as discussed in detail in connection with FIG. 4. The media transport system 100, thus, provides for tighter actual lead-in guide tip to nip plane spacing tolerances and better control of sheet movement along any media transport path, curved or flat, without requiring expensive control of various component manufacturing tolerances.

Positioning the lead-in guides 108 and 202 substantially close to the tangent point of the nip 106 greatly minimizes the effect of tolerance variations arising from factors unrelated to roller shaft deflection or lead-in guide part-tolerance. Analysis shows that employing such lead-in guides reduces drive force requirement by about 40% in comparison to a conventional curved baffle transport while transporting heavy media in a curved media transport path. Consequently, the media transport system 100 allows for smaller drive forces, imposes less stress on sheets, and reduces operational noise.

Figure 3:
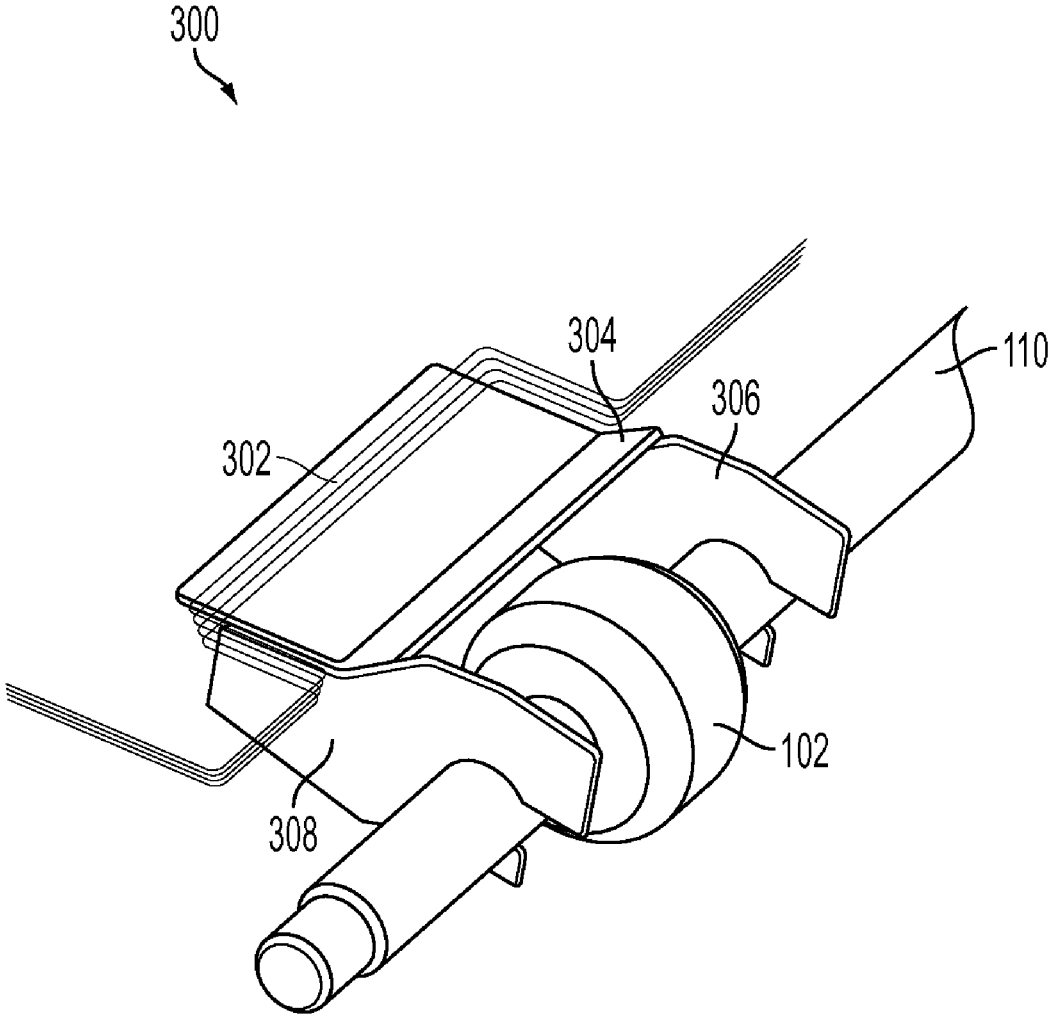
FIG. 3 is a perspective view of a snap-on lead-in guide positioned by a roller shaft.

FIG. 3 is a perspective drawing 300 of a snap-on lead-in guide 302 for guiding a sheet to the drive roller 102 in a media transport system. Although FIG. 3 depicts a single drive roller 102, in practical systems, the drive roller 102 can be positioned adjacent to another roller forming a nip for conveying the sheet media along a media transport path. The lead-in guide 302 includes a ramp surface 304 leading up to a nip tangent plane, and a pair of support guides 306 and 308 that couple the lead-in guide 302 to the drive shaft 110 of the drive roller 102. The support guides 306 and 308 straddle the drive roller 102 and extend up to and past the nip centerline, thus, precisely guiding media to the tangent plane of the nip. Several factors contribute towards system tolerances such as variations in vertical or angular position of the ramp surface 304 relative to the nip tangent line, defects in baffle flatness, or distance between the nip and the tip of the lead-in guide 302. As the support guides 306 and 308 ensure that the lead-in guide 302 moves with the drive shaft 110, contribution of these factors towards tolerance values is eliminated or greatly minimized. A few such factors affecting tolerance values in a media transport system are described in detail in connection with the description of FIG. 4 below. The snap-on lead-in guide 302 provides tighter tolerance values and, thus, allows for smaller drive force requirements in media transport systems. Further, in various embodiments, the lead-in guide 302 may be manufactured from sheet metal, or may be a one-piece plastic molding, could be formed using a combination of plastic and metal components, or other suitable construction, thus reducing manufacturing costs.

Figure 4:
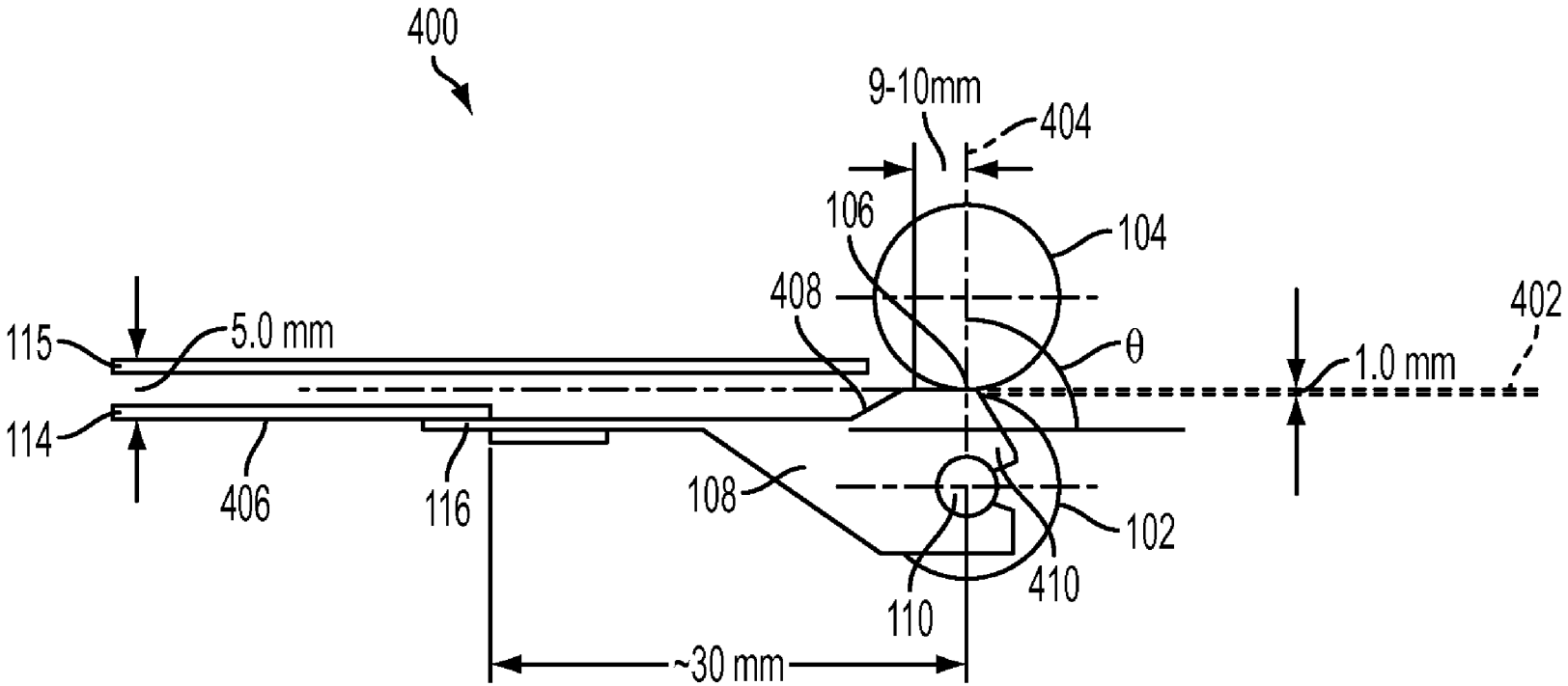
FIG. 4 illustrates an elevation of an embodiment of the media transport system.

FIG. 4 illustrates an embodiment of the present disclosure, directed to an alternative media transport system 400. The media transport system 400 includes the rollers 102 and 104 forming the nip 106, and the outer baffles 114 and 115 for guiding a sheet along a media transport path. The outer baffle 114 further includes a larger baffle element 406, and the smaller lead-in guide 108 coupled to the drive shaft 110 of the drive roller 102. The lead-in guide 108 lies at an angle to the remaining of the outer baffle 114 and includes a ramp 408 for guiding the sheet towards the nip 106. Several factors such as the ramp angle θ, distance between the ramp tip terminus to nip centerline 404, and distance between the ramp tip terminus and a nip tangent plane 402 are carefully determined for precisely guiding the sheet substantially close to the tangent plane of the nip 106. Further, in order to ensure optimal nip entry by precisely positioning the lead-in guide 108 relative to the nip 106, the angular position of the lead-in guide 108 is constrained by engaging the lead-in guide 108 in the slot 116 of the outer baffle 114. In alternative embodiments, the lead-in guide 108 may include one or more other elements provided on the larger baffle element 406 for constraining rotation of the lead-in guide 108.

The lead-in guide 108 further includes at least one side support 410, coupled to the drive shaft 110, and extending up to the nip tangent plane 402, for minimizing tolerance values arising out of relative positioning of the lead-in guide 108 and the nip rollers. Minimizing the tolerance values allows for minimizing the ramp tip terminus to nip plane spacing and thus, the minimization of the drive force requirements in the media transport system 400. The drive force required to drive the sheet through the nip 106 especially on a curved media transport path depends on the relative positioning between the outer baffle 114 and the nip plane or the lead-in guide to nip geometry. Consequently, several design characteristics of the lead-in guide to nip geometry affect tolerance values, and therefore the drive force requirements of the media transport system 400.

Important design characteristics include ramp angle variations, roller diameter, shaft run out, shaft deflection, shaft straightness, baffle flatness, ramp tip terminus to nip plane gap, and ramp tip to ramp tip gap for a system with two opposing guides. The ramp tip terminus to nip plane gap, for example, should be minimal to limit the drive force required to drive the sheet precisely to the tangent plane of the nip. Designing the support 410 to extend past the nip centerline 404 ensures that the sheet is guided substantially close to the nip tangent plane 402. The support 410, thus, promotes greater control of sheet movement by guiding the leading edge of the sheet media smoothly into, and through the nip contact even after the sheet leading edge has passed the ramp tip terminus.

Table 1 is a listing of typically achieved manufacturing tolerances for the commonly practiced, and the disclosed construction of a media handling transport for demonstrating the effectiveness of the disclosed techniques in reducing critical tolerance accumulations. The important characteristics are listed for a conventional baffle and a baffle with the disclosed lead-in guide 108, showing nominal, and root mean square (RSS) tolerance accumulation values. As can be seen by the measurements in Table 1, the proposed lead in guide results in a much smaller tolerance between the lead-in guide 108 and the nip 106. This means that the nip 106 can be nominally positioned close to the tip of the lead-in guide 108 without the risk that the nip 106 will fall below the lead-in guide 108 under worst-case tolerance conditions. Whereas, in a conventional design, the nip 106 must be nominally positioned well above the outer baffle 114 to ensure that the nip 106 will never be below the outer baffle 114 under worst-case tolerance conditions.

TABLE 1

| Factors affecting tolerance | | | | |
|---|---|---|---|---|
| | Conventional Sheet Metal Baffle | | Baffle with disclosed Lead-In Guide | |
| Baffle/Guide-to-Nip Tolerance Contributors | Tolerance (mm) | (values for use in RSS calculation) | Tolerance (mm) | (values for use in RSS calculation) |
| Baffle flatness tolerance (+ or −) | 1.2 | 1.44 | NA | NA |
| Baffle mounting to shaft mounting dimension - frame tolerance | 0.25 | 0.063 | NA | NA |

TABLE 1-continued

| Factors affecting tolerance | | | | |
|---|---|---|---|---|
| | Conventional Sheet Metal Baffle | | Baffle with disclosed Lead-In Guide | |
| Baffle/Guide-to-Nip Tolerance Contributors | Tolerance (mm) | (values for use in RSS calculation) | Tolerance (mm) | (values for use in RSS calculation) |
| Effect at Tip Terminus of lead-in guide - anti rotation feature tolerance on baffle | 0.08 | 0.006 | NA | NA |
| Shaft run-out (TIR) tolerance | 0.15 | 0.023 | NA | NA |
| Shaft deflection due to nip load | 0.3 | 0.09 | NA | NA |
| Roller Diameter tolerance | 0.1 | 0.01 | 0.1 | 0.01 |
| Lead-in tip terminus to shaft mounting feature - guide tolerance | NA | NA | 0.13 | 0.017 |
| Lead-in within part tolerance | NA | NA | 0.13 | 0.017 |
| Total Sum of Tolerances | 2.08 mm | | .0.36 mm | |
| Total RSS of Tolerances | | 1.28 mm | | 0.21 mm |
| IMPROVEMENT | Base case | Base case | 6:1 | 6:1 |

Here, nip penetration is defined to be the height of one of the nip rollers above the outer baffle 114, and an assumption of optimal nip penetration of 0.2 mm is made. Table 1 measurements show that a conventional baffle design would require a nip penetration of roughly 1.5 mm+/−1.3 mm (0.059 in.+/−0.051 in.) (or a range of 0.2 mm to 2.8 mm 10.008 in. to 0.110 in.)), based on the RSS tolerances. A design with a nip penetration of 2.8 mm (0.110 in) can causes the leading edge of the sheet media to stub into the rollers 102 and 104, producing a highly undesirable torque spike. In contrast, the outer baffle 114 including the disclosed shaft-mounted lead-in guide 108 results in nip penetration of 0.4 mm+/−0.2 mm (0.016 in.+/−0.008 in.), or a range of just 0.2 to 0.6 mm (0.008 in.+/−0.024 in.) because the guide is coupled directly to the drive shaft 110. In these examples, the minimum gap is set at 0.2 mm (0.008 in.) and the nominal is set at 0.2 mm (0.008 in.) plus the calculated RSS tolerance. The improved design, thus, reduces the tolerance, and achieves maximum nip penetration.

In embodiments where the support 410 and the tip of the ramp 408 extend up to the nip tangent plane 402, the tolerance values, even for heavy or thick media are extremely low, translating into lower drive force requirements in media transport systems. Additionally, as the lead-in guide 108 can be made from metal or plastic, the manufacturing costs can be kept quite low. Employing the lead-in guide 108 in the media transport system 400, thus, provides a lot of latitude for handling different kinds of media in the same device.

FIGS. 5-7 illustrate various embodiments of media transport systems including baffle elements employed for constraining the angular movement of a lead-in guide coupled to a roller shaft. Restriction of angular movement enables precise positioning of the lead-in guide relative to nip rollers for ensuring optimal entry of sheet media into a nip formed by two rollers. The arrangement of the media transport systems, except the illustrated lead-in guides in each of the FIGS. 5-7, is similar to the arrangement of the media transport system 100 described in connection with the description of FIG. 1.

FIG. 5 illustrates a media transport system 500 comprising a lead-in guide 502. The lead-in guide 502 includes a ramp 506, a slot 508 intended to fit over a cross brace 510 to establish a predetermined angular position of the disclosed lead-in guide 502, and an opening 504 to enable the lead-in guide 502 to snap-on to the drive shaft 110 of the drive roller 102. The slot 508 and the cross brace 510 ensure that once the lead-in guide 502 snaps on to the drive shaft 110, further angular movement is minimized. The position of the lead-in guide 502, thus, remains substantially fixed relative to the nip tangent plane 402 for guiding a sheet precisely to the tangent plane of the nip 106.

Similarly, FIG. 6 depicts another embodiment of a media transport system 600 comprising a snap-on lead-in guide 602, which further includes at least one fastening element 604 coupled to the outer baffle 114. The fastening element 604 is sized to fit tightly into at least one mating receptor feature 608 in the lead-in guide 602 for constraining the angular movement of the lead-in guide 602. Ramp 606 lies at an angle of 30°, ±4°, to the outer baffle 114.

FIG. 7 illustrates yet another embodiment of a media transport system 700 comprising a lead-in guide 702, which further includes at least one stop element 704 integrated into the outer baffle 114. Upon being aligned along a tangential plane of the drive roller 102, the stop element 704 minimizes the effect of tolerances introduced due to angular orientation of the lead-in guide 702 and associated baffle-roller gap. Further, the lead-in guide 702 may be spring loaded against the stop feature 704 for facilitating jam-removal in an image-forming device. Ramp 706 lies at an angle β to the incoming media. Although FIGS. 5-7 illustrate various embodiments of baffle elements employed for constraining the angular movement of a lead-in guide coupled to a roller shaft, it would be apparent to one of skill in the art that other means to constrain angular movement of the lead-in guide may be employed.

The disclosed lead-in guide can be made from plastic enabling inexpensive implementation that avoids damage and has good precision for both lighter than 75 grams per square meter (GSM) media, and heavier than 300 GSM media employed in packaging. Analysis shows that employing such lead-in guides in media transport systems can reduce required drive forces by up to 40% relative to a conventional curved baffle transport especially while transporting heavy media in a curved paper path. These lead-in guides, thus, allow for smaller drive motors, imposes less stress on the media, improve jam-rate reliability, and even reduce operational noise.

The specification has described a lead-in guide suitable for guiding media in a media transport system. The specification has set out a number of specific exemplary embodiments, but persons of skill in the art will understand that variations in these embodiments will naturally occur in the course of embodying the claimed invention in specific implementations and environments. Certain features that are described in this specification in the context of separate embodiments can also be implemented in combination in a single embodiment. Conversely, various features that are described in the context of a single embodiment can also be implemented in multiple embodiments separately or in any suitable sub-combination.

It will be appreciated that several of the above-disclosed and other features and functions, or alternatives thereof, may be desirably combined into many other different systems or applications. It will further be understood that such variations and others as well, fall within the scope of the claimed invention. Neither those possible variations nor the specific examples set above are set out to limit the scope of the claimed invention. Rather, the scope of claimed invention is defined solely by the claims set out below.

What is claimed is:

1. A media transport system comprising:

a roller system including a drive roller and an idler roller, each roller being mounted on a corresponding drive shaft and an idler shaft, respectively, the roller system including a nip between the rollers, and a baffle positioned to guide sheet media having a leading edge and a trailing edge-to the nip, the baffle being pivotally mounted on at least one of the drive shaft and the idler shaft for precisely locating the baffle relative to the roller system;

wherein the baffle includes:

a lead-in guide, to direct the leading edge of the sheet media to the nip; and a slot engaging a portion of the lead-in guide, to constrain the angular movement of the lead-in guide.

2. The system of claim 1, wherein the lead-in guide is positioned at an angle relative to a remainder of the baffle.

3. The system of claim 1, wherein the lead-in guide further includes a snap-on element adapted to snap onto at least one of the drive shaft or the idler shaft.

4. The system of claim 1, wherein the lead-in guide directs the leading edge of the sheet media to a tangent plane of the nip.

5. The system of claim 4, wherein the lead-in guide includes at least one support, the at least one support extending substantially close to the tangent plane of the nip.

6. The system of claim 1, wherein separate lead-in guides are coupled to the drive shaft and the idler shaft.

7. A media transport system comprising:

a roller system including a drive roller mounted on a drive shaft, and an idler roller mounted on an idler shaft, the roller system including a nip between the drive roller and the idler roller;

a baffle positioned to guide sheet media to the roller system; and a lead-in guide pivotally mounted on at least one of the drive shaft or the idler shaft to direct a leading edge of sheet media to the nip, the lead-in guide lying at an angle to the baffle, wherein the lead-in guide is further coupled to the baffle, and the baffle includes a slot engaging a portion of the lead-in guide, to constrain the angular movement of the lead-in guide.

8. The system of claim 7, wherein the lead-in guide further includes a snap-on element to snap onto at least one of the drive shaft or the idler shaft.

9. The system of claim 7, wherein the lead-in guide directs the leading edge of the sheet media substantially close to a tangent plane of the nip.

10. The system of claim 9, wherein the lead-in guide includes at least one support mounted to at least one of the drive shaft or the idler shaft, the at least one support extending substantially close to the tangent plane of the nip.

11. The system of claim 7, wherein the lead-in guide includes at least one support mounted to at least one of the drive shaft or the idler shaft, the at least one support extending substantially close to a nip centerline.

12. The system of claim 7, wherein the lead-in guide is made at least in part from at least one of plastic or metal.

13. A sheet media transport system comprising:

a drive roller mounted on a drive shaft;

an idler roller mounted on an idler shaft, the system including a nip between the drive roller and the idler roller, and a baffle system including a baffle element positioned to guide the sheet media towards the nip, and at least one lead-in guide pivotally mounted on at least one of the drive shaft or the idler shaft, wherein the baffle includes a slot engaging a portion of the lead-in guide, to constrain the angular movement of the lead-in guide.

14. The system of claim 13, wherein the lead-in guide includes at least one support mounted to at least one of the drive shaft or the idler shaft, the lead-in guide lying at an angle to a remainder of the baffle system.

15. The system of claim 14, wherein the at least one support extends at least to a nip centerline.

16. The system of claim 14, wherein the at least one support extends substantially close to a nip tangent plane.

17. A method of claim 13, wherein the lead-in guide further includes a snap-on element adapted to snap onto at least one of the drive shaft or the idler shaft.

* * * * *